United States Patent [19]

Nattrass

[11] Patent Number: 5,023,969

[45] Date of Patent: Jun. 18, 1991

[54] NOVEL BLANKET/SHEET FOR A DOUBLE BED

[76] Inventor: Douglas J. Nattrass, 80 Queens Cir., Chalfont, Pa. 18914

[21] Appl. No.: 506,225

[22] Filed: Apr. 9, 1990

[51] Int. Cl.[5] ..... A47G 9/02

[52] U.S. Cl. ..... 5/486; 5/502

[58] Field of Search ..... 5/485, 486, 494, 496, 5/502

[56] References Cited

U.S. PATENT DOCUMENTS

| | | | |
|---|---|---|---|
| 2,689,961 | 9/1954 | Lieberthal | 5/486 |
| 2,730,728 | 1/1956 | Roberts | 5/486 |
| 4,005,499 | 3/1976 | Klein | 5/486 X |
| 4,802,251 | 12/1987 | O'Dell | 5/486 X |

FOREIGN PATENT DOCUMENTS

| | | | |
|---|---|---|---|
| 625927 | 8/1961 | Canada | 5/486 |
| 2150290 | 10/1970 | Fed. Rep. of Germany | 5/486 |

*Primary Examiner*—Michael F. Trettel

*Attorney, Agent, or Firm*—Joseph W. Molasky & Assocs.

[57] ABSTRACT

An arrangement for a cover sheet and/or blanket to allow full or partial use by persons sleeping or resting in a side-by-side position. The cover unit is constructed whereby the sheet/blanket is split and each person may have the warmth provided by a complete unit or, alternatively, the coolness provided by no covering without disturbing the needs of the adjacent person.

14 Claims, 3 Drawing Sheets

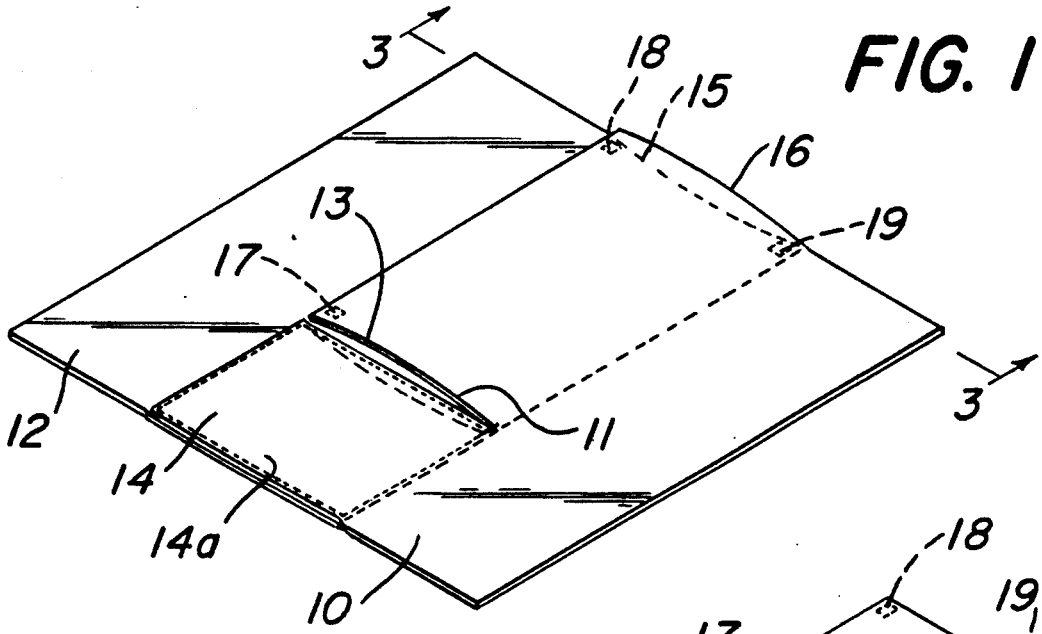
FIG. 1
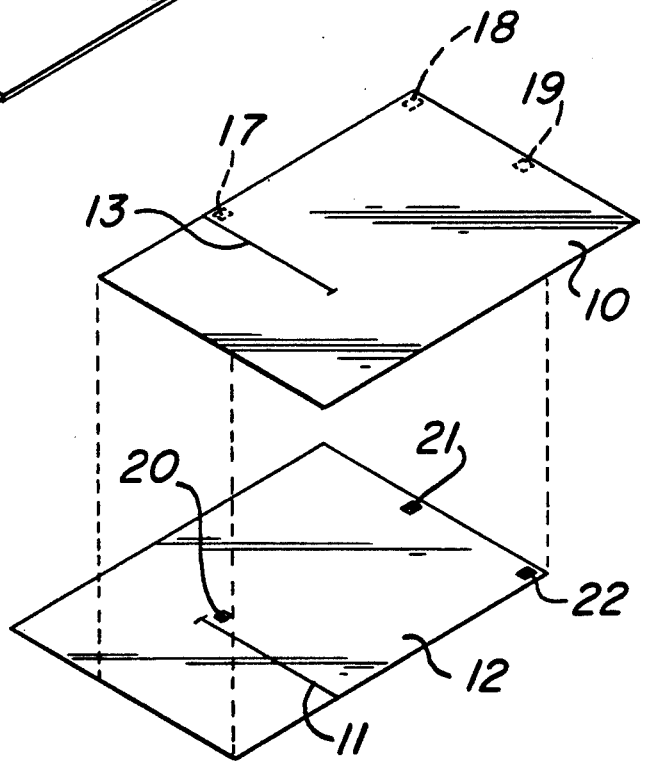
FIG. 2
FIG. 3
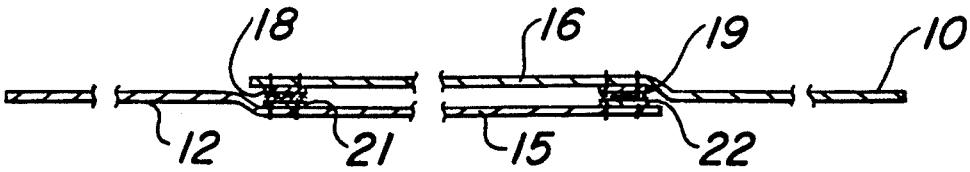

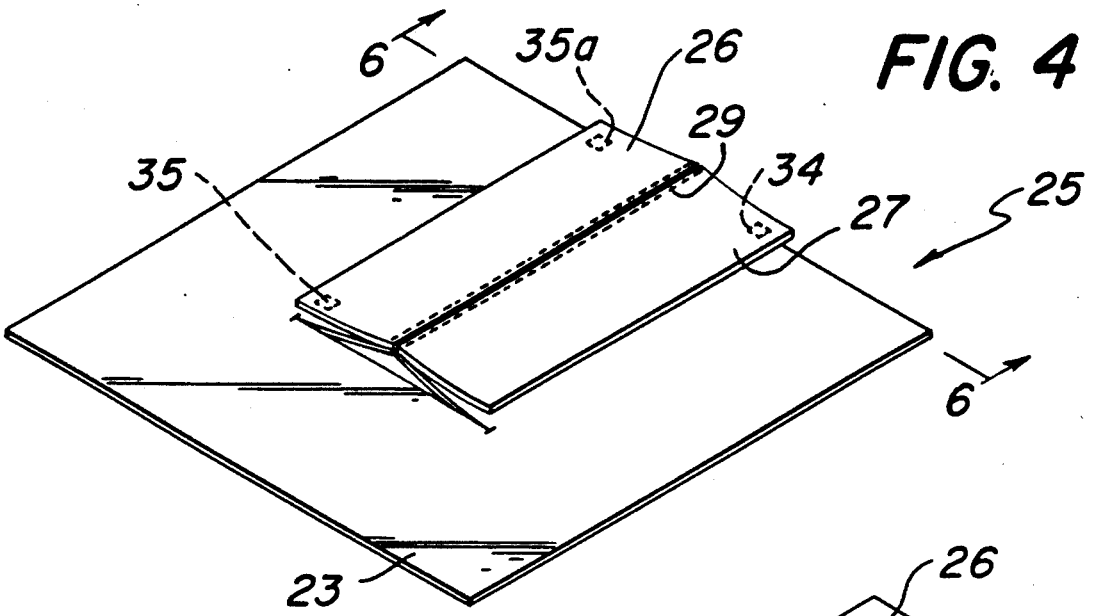
FIG. 4
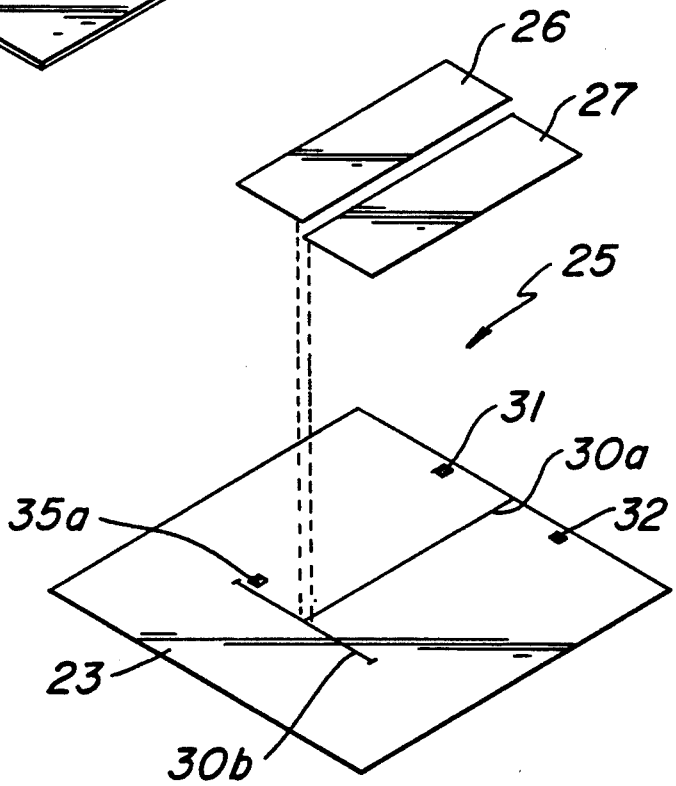
FIG. 5
FIG. 6
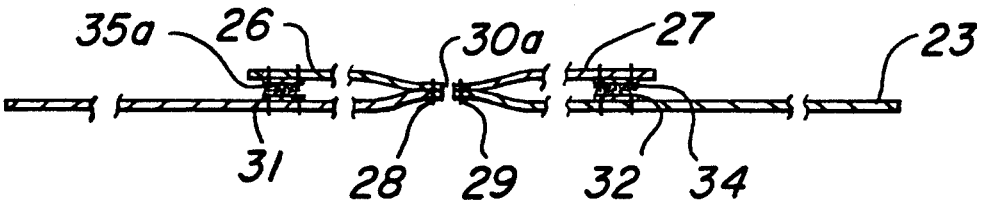

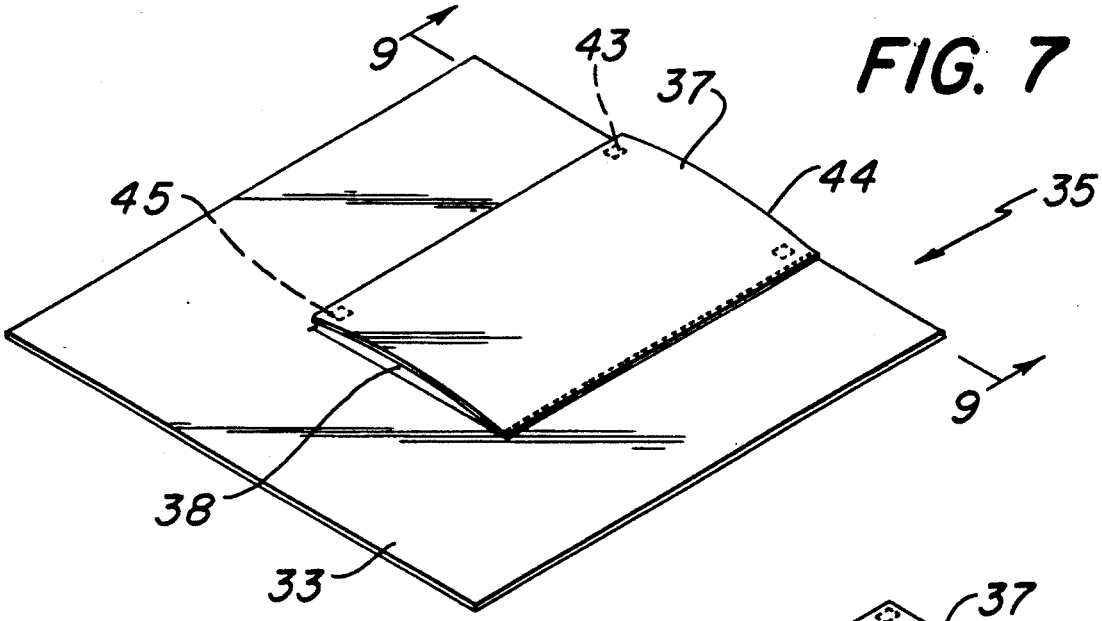
FIG. 7
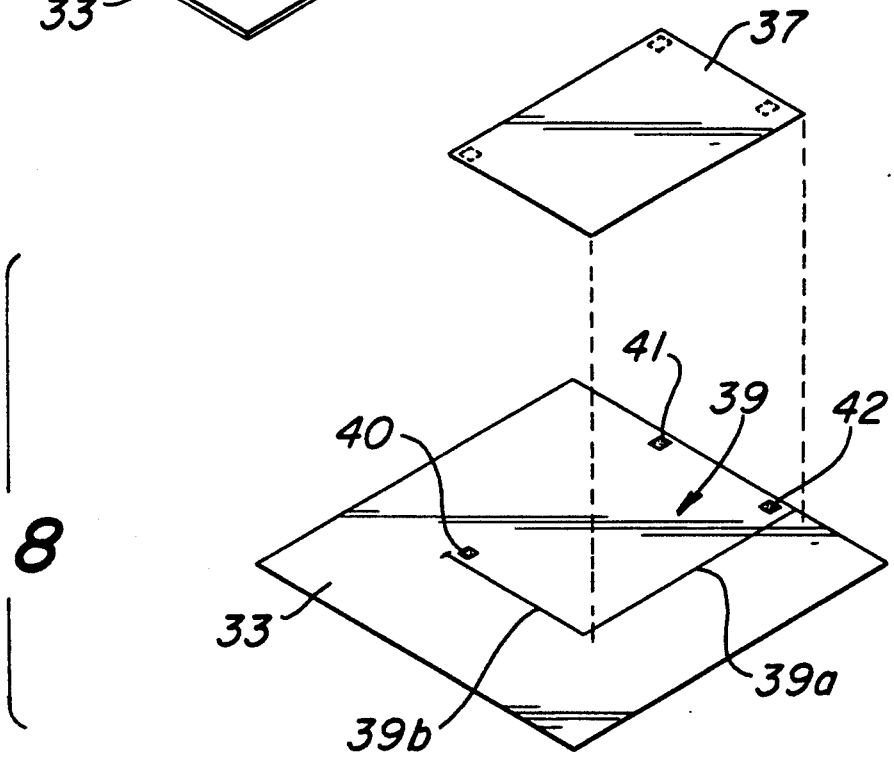
FIG. 8
FIG. 9
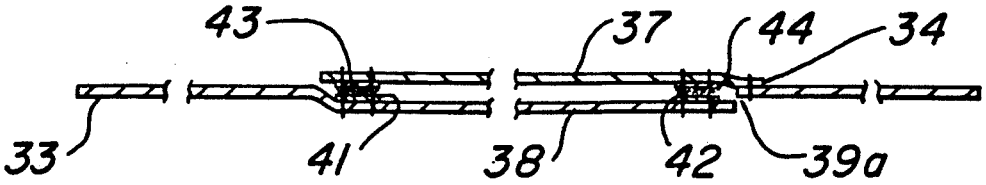

NOVEL BLANKET/SHEET FOR A DOUBLE BED

BACKGROUND OF THE INVENTION

The present invention relates in general to the blanket and/or sheet art and, in particular, relates to a unique arrangement for utilizing such appointments in a bed.

It is a well recognized problem that when two persons are resting or sleeping in a double bed, one person will often awaken with none of the blanket covering, whereas, the adjacent person will have unconsciously appropriated all of it. This problem normally results from the different temperature needs of the two people who are sleeping in a side-by-side relationship.

The invention is designed to alleviate this situation by permitting one of the persons to cover himself with the blanket/sheet covering while the other person is free to remove the covering as desired. This is accomplished in one particular mode by partially overlapping two blankets together so that two flaps are formed where one of the flaps is associated with each respective person. This configuration allows each person to individually provide for his comfort zone by retaining or removing his blanket/sheet flap.

SUMMARY OF THE INVENTION

The various embodiments of the invention disclose a blanket or sheet construction that allows two persons sleeping or resting in a side-by-side relationship to customize their need for warmth. As a result a person on either side of the bed may have a full blanket; in addition, the person on either side may change the blanket/-sheet arrangement by tucking their half sidewardly or downwardly to eliminate the full sheet/blanket for coolness without disturbing the status of the adjacent person. The invention therefore allows either person sleeping side-by-side to split the blanket/sheet covering.

Three different design embodiments are provided by the invention to accomplish the purposes of the invention.

In one embodiment, two identical coverings are partially positioned upon each other so that a respective horizontal slit, which is formed an equal distance from an upper reference point but on opposite sides of each blanket, are placed over one another. A small rectangular area under the slits is stitched together in order to fix the two coverings to one another. This blanket formation forms two overlapping flaps where each may be folded in two different directions. Therefore, each party may have a full covering or no covering without interferring with the adjacent person.

In another embodiment, a single covering unit is provided with a T-shaped slit where the vertical portion of the T is located in the middle of the covering and originates from the top of the unit. Respective flaps that are no wider than one half of the distance of the horizontal portion of the T are then located on each side of the vertical portion of the T slit. The side of the respective flaps juxtaposed to the vertical T portion is stitched to the underlying covering upon which they are positioned. In all other respects the covering operates in the manner as the embodiment previously described.

The third embodiment of the invention utilizes a reverse L-shaped slit where the inner area of the L forms one flap in the covering. A second flap that is congruent with the first flap is fixed upon the sheet/-blanket so that both are independently movable. The operation of the blanket is identical to the previously described embodiments which allows each party in a double bed arrangement to split the blanket to satisfy their respective warming needs.

The various embodiments of the invention include hold down devices in relation to the flap arrangement in order to maintain tautness and therefore neatness to the covering when positioned in a made-up mode.

Accordingly, it is an object of the invention to provide a unique blanket and/or sheet covering that is designed to enable either person resting in a double bed to split the covering to accommodate their respective thermal requirements.

BRIEF DESCRIPTION OF THE DRAWINGS

FIG. 1 illustrates an embodiment of the invention which utilizes two blankets and/or sheet units in an overlapping arrangement and wherein a small rectangular area is stitched together.

FIG. 2 depicts the two units with accompanying slit which are utilized in the embodiment of FIG. 1.

FIG. 3 represents a cross-sectional view taken along line 3—3 of FIG. 1.

FIG. 4 depicts another embodiment of the invention which utilizes a T-shaped slit in a covering for use with two flaps respectively located on either side of the vertical portion of the T.

FIG. 5 is an exploded view showing the relationship of the flaps and the T-shaped slit.

FIG 6 is a cross-sectional view taken along line 6—6 of FIG. 4.

FIG. 7 is an illustration of another embodiment of the invention employing a reverse L-shaped slit in a covering upon which is attached a flap over an existing flap.

FIG. 8 is an exploded view showing the relationship of the flap, the L-shaped slit and the blanket/sheet covering.

FIG. 9 is a cross-sectional view taken along line 9—9 of FIG. 7.

DESCRIPTION OF THE PREFERRED EMBODIMENT

Referring to FIG. 1 of the drawings there is depicted an embodiment of the invention where two blankets and/or sheets 10, 12 are positioned with respect to one another to form a unique covering 9. The covering 9 is designed for use with a double bed whether king, queen or regular size and is particularly formed to accommodate the different thermal needs of two persons sleeping in a side-by-side relationship.

Covering 9, as will be described in detail hereinbelow, allows either person to split the blanket/sheet arrangement to provide desired warming or cooling without disturbing the thermal needs of the adjacent person. The novel covering 9 of the invention is initially produced by means of the two blankets/sheets 10, 12 as shown in FIG. 2 which include two horizontal slits 11, 13. The slits 11, 13 are identically formed in each blanket/sheet 10, 12 approximately two-thirds the distance from the top but on opposite sides. The distance of the slits 11, 13 from the top of the covering 9 correspond to an approximate mid-thigh position with respect to the persons sleeping side-by-side.

The covering 9 is formed by positioning the respective blankets/sheets 10, 12 over one another so that the slits 11, 13 are congruent or coincide exactly when superimposed over one another. A rectangular area 14 immediately below the superimposed slits is formed and is utilized to join the two blankets 10, 12 to one another. This is accomplished by stitching 14*a* that follows the outline of the rectangle 14 immediately below the superimposed slits 11, 13.

Two rectangular flaps 15, 16 are formed above the superimposed slits 11, 13 and this arrangement allows each person sleeping or resting in a side-by-side position to provide for their respective thermal needs without disturbing the adjacent person. In effect, the covering 9 is able to be split in accordance with temperature requirements of each person.

The superimposed slits 11, 13 in combination with the stitched rectangular area 14 allows the two blankets 10, 12 to function in a manner that allows each person to have two options when providing for their respective temperature needs. Thus, when both parties desire full warmth the configuration of the covering 9 will be as shown in FIG. 1 wherein the flaps 15, 16 are positioned over one another.

The second option that is available allows each party to fold the respective flaps as well as the connecting covering downwardly in order to lower the temperature zone for an individual. This option may be better understood by referring to FIG. 1 as viewed from the bottom of the covering 9 in the vicinity of the stitched rectangular square 14 and looking upwardly. A person sleeping on the right hand side of a double bed and not desiring the warmth provided by any of the covering 9 would grasp the flap 16 and fold it downwardly. This action causes not only the flap 16 but also a lateral portion of the blanket/sheet 10 to the right of the flap to be removed. As a result of this action only a portion of the blanket/sheet 10 below the mid-thigh point of the person removing a portion of covering 9 is left for warming purposes. The removal action of the person on the right side of the bed is done independently of the person on the left. Consequently, the person on the left may duplicate the removal of covering of the person on the right for coolness or may retain the covering 9 for purposes of warmth.

With reference to the cross-sectional view of FIG. 3, the overlapping configuration of the flaps 15, 16 is shown where the upper fasteners 18, 19 and the lower mating fasteners 21, 22 are illustrated. Additional upper and lower fasteners 17, 20 are provided in a third corner as shown in FIG. 1. The upper and lower fasteners which may be respective male and female Velcro components, are provided in at least three corners to keep the flaps 15, 16 taut with respect to one another when the double bed is being made up; it is desirable to have the covering 9 reasonably flat in order to give a pleasing appearance.

FIG. 4 represents another embodiment of the invention wherein the covering 25 is comprised of a single blanket/sheet 23 to which is applied a T-shaped slit 30 (see FIG. 5). The T slit 30 is formed with a vertical portion 30*a* beginning from the top of the blanket/sheet 23 and extending downwardly a distance of two-thirds where the horizontal portion 30*b* is formed.

Two flaps 26, 27 are located on either side of the vertical 30*a* and within the distance provided by one-half of the horizontal 30*b*. The flaps 26, 27 are attached to the blanket/sheet 23 by stitching 28, 29 that is applied on either side of the horizontal slit 30*a* (see FIGS. 4, 6).

The operation of the embodiment in FIGS. 4–6 is similar to the embodiment of FIGS. 1–3. FIGS. 4 and 6 illustrate the utilization of the covering 25 when both parties sleeping in a side-by-side relationship respectively desire the warmth provided by a full blanket/sheet 23. In this configuration the flaps 26, 27 in combination with the blanket/sheet 23 furnish complete thermal warmth to the respective persons sleeping on the left and right side as viewed from the horizontal portion 30*b* of the T.

In the event that the person sleeping or resting on the left side desires to independently eliminate the warmth of a full covering, the flap 26 is grasped and folded downwardly. The left side of the covering 13 laterally opposite the flap 26 as well as the section to which it is stitched is also folded downwardly by this grasping and folding action. By this procedure all of the blanket/sheet 23 is removed from the left-hand resting person up to approximately a mid-thigh position without interfering with the person on the right side. Therefore, the person on the left is able to maintain a cool state and the person on the right is able to maintain a warm status.

In the manner previously described the rightwardly position person under the covering 25 is able to independently exercise the two options of maintaining or removing the flap 27 and portion of blanket 23 in order to satisfy his thermal needs.

Attaching devices 31, 32, 33 are located in three corners (see FIG. 5) of the blanket/sheet 23 in the form of female Velcro components; in addition, mating male Velcro components 35*a*, 34, 35 are provided in corresponding corners of the respective flaps 26, 27. The male and female Velcro mating components are utilized to keep the flaps 26, 27 in a taut condition in order to present a pleasing appearance when the covering 25 is in a made-up condition.

Another embodiment of the invention is presented in FIG. 7 where a covering 35 is presented having a reverse shaped L slit 39 formed in the blanket/sheet 33 (see FIG. 8). The reverse L-shaped slit includes a vertical element 39*a* and a horizontal element 39*b*. The horizontal element is located approximately two-thirds of the distance form the top of the blanket/sheet 33, whereas, the vertical element is positioned at approximately two-third of the distance from the right hand side as viewed from below the horizontal element 39*b*.

Within the outline provided by the reverse L-shaped slit 39 a flap 37 is joined to the blanket 33 by stitching 34 which is applied along the outside of the vertical leg 39*a*. As a result, two flaps are formed where one flap 38 consists of the area outlined by the reverse L-shaped slit, and the second is the stitched flap 37 attached to the blanket/sheet 33. In all other respects the embodiment of FIGS. 7–9 operate in an identical manner to the previously discussed embodiments.

In summary, the operation of the covering 35 allows two independent options: namely, under one option the respective flaps 37, 38 may be folded over the two persons sleeping or resting in a side-by-side positioning to provide full warmth as shown in FIG. 7, and under the second option the respective flaps 37, 38 together with attached portions of blanket 33 may be folded downwardly up to approximately mid-thigh in order to provide desired coolness.

As shown in the previous embodiments, female Velcro components 40, 41, 42 are located in at least three corners of flap 38 for mating with Velcro male components 43, 44, 45.

This invention has been described by reference to precise embodiments but it will be appreciated by those skilled in the art that this invention is subject to various modifications and to the extent that those modifications would be obvious to one of ordinary skill they are considered as being within the scope of the appended claims.

What is claimed is:

1. The combination comprising:

(a) a rectangular member comprising a first and second rectangular member for placement upon a mattress and upon the bodies of respective first and second persons positioned in a side-by-side relationship;

(b) a slit formed in each rectangular member at a same location but on opposite sides thereof, (c) said first and second members being placed in an overlapping relationship with one another by providing a congruent placement of said slits to form first and second overlapping flaps;

(d) said first member allowing said first person to maintain a comfort zone by retaining or alternatively removing said member from the body;

(e) said second member allowing said second person to maintain a comfort zone by retaining or alternatively removing said member from the body; and (f) said first and second member being independently controllable.

2. The combination in accordance with claim 1 wherein said first and second rectangular members are attached to one another in a rectangular area immediately below said overlapping flaps.

3. The combination in accordance with claim 1 wherein said respective slits are provided at a distance of approximately two-thirds from the top of said first and second rectangular members.

4. The combination in accordance with claim 1 wherein semi-permanent fasteners are provided at three of the corners provided by said flaps.

5. The combination in accordance with claim 1, wherein semi-permanent fasteners are located at three corners between said first and second flaps.

6. The combination comprising:

(a) a rectangular member for placement upon a mattress and upon the bodies of first and second persons positioned in a side-by-side relationship;

(b) a T-shaped slit formed in said rectangular member;

(c) first and second flaps attached to said member along each side of the vertical portion of the T-slit;

(d) said first attached flap allowing said first person to maintain a comfort zone by retaining or alternatively removing said flap from the body;

(e) said second attached flap allowing said second person to maintain a comfort zone by retaining or alternatively removing said flap from the body; and (f) said first and second attached flaps being independently controllable.

7. The combination in accordance with claim 6 wherein semi-permanent fasteners are placed upon three of the corners of said two flaps.

8. The combination in accordance with claim 6 wherein the horizontal portion of said T slit is located approximately two-thirds from the top of said rectangular members.

9. The combination comprising:

(a) a rectangular member for placement upon a mattress and upon the bodies of first and second persons positioned in a side-by-side relationship;

(b) an L-shaped slit formed in said rectangular member;

(c) a flap attached to said rectangular member within the outline provided by said L-shaped slit to form first and second flaps;

(d) said first flap allowing said first person to maintain a comfort zone by retaining or alternatively removing said first flap from the body;

(e) said second flap allowing said second person to maintain a comfort zone by retaining or alternatively removing said flap from the body; and (f) said first and second flaps being independently controllable.

10. The combination comprising:

(a) at least one integrally formed cloth member for fitting on top of a double bed;

(b) at least one slit formed in said cloth member which does not destroy its integrity;

(c) means located upon said member and attached along said formed cut to form flaps; and (d) said flaps in combination with a portion of said cloth member being utilized to maintain the comfort zone of persons occupying said double bed or alternatively being independently controllable in a sideway or a downward direction without effecting the comfort zone of an opposite person.

11. The combination in accordance with claim 10, wherein fastening means are provided in various corners of said flaps so that they may be attached to one another or alternatively to said cloth member.

12. The combination in accordance with claim 11 wherein said slit is T-shaped.

13. The combination in accordance with claim 11 wherein said slit is L-shaped.

14. The combination in accordance with claim 11 wherein at least two integrally formed cloth members which are combined to form a single cloth member, each said cloth member having a single horizontal slit which are placed in congruency with one another.

* * * * *